US005924405A

United States Patent [19]

Hashimoto

[11] Patent Number: 5,924,405

[45] Date of Patent: Jul. 20, 1999

[54] APPARATUS AND METHOD FOR INJECTING FUEL IN CYLINDER INJECTION TYPE ENGINES

[75] Inventor: Hiromasa Hashimoto, Toyota, Japan

[73] Assignee: Toyota Jidosha Kabushiki Kaisha, Toyota, Japan

[21] Appl. No.: 08/992,479

[22] Filed: Dec. 17, 1997

[30] Foreign Application Priority Data

Dec. 19, 1996 [JP] Japan ..... 8-339789

[51] Int. Cl.[6] ..... F02D 41/06; F02B 11/00

[52] U.S. Cl. ..... 123/431; 123/430; 123/295

[58] Field of Search ..... 123/431, 430, 123/295, 305

[56] References Cited

U.S. PATENT DOCUMENTS

| | | | |
|---|---|---|---|
| 4,408,582 | 10/1983 | Merrick | 123/482 |
| 5,052,360 | 10/1991 | Ingle, III et al. | 123/430 |
| 5,181,493 | 1/1993 | Motoyama et al. | 123/431 |
| 5,251,582 | 10/1993 | Mochizuki | 123/431 |
| 5,313,920 | 5/1994 | Matsushita | 123/431 |

FOREIGN PATENT DOCUMENTS

| | | |
|---|---|---|
| U-5-1854 | 1/1993 | Japan . |
| A-6-200857 | 7/1994 | Japan . |
| A-7-103050 | 4/1995 | Japan . |

*Primary Examiner*—Andrew M. Dollnar
*Assistant Examiner*—Jason Benton
*Attorney, Agent, or Firm*—Oliff & Berridge, PLC

[57] ABSTRACT

An improved apparatus and method for controlling fuel injection in an internal combustion engine. The engine includes main-injection valves for directly injecting fuel into corresponding combustion chambers and a sub-injection valve for injecting fuel into a surge tank. The engine is able to perform a plurality of fuel injection modes. An ECU selects a homogeneous fuel injection mode, in which the injected fuel is evenly mixed with air supplied into the combustion chamber, from the plurality of fuel injection modes when the engine is being cranked and fuel injected from the main-injection valve will not adequately vaporize in the combustion chamber. The ECU controls the first and second injection valves according to the selected fuel injection mode. This improves engine starting and increases fuel efficiency.

17 Claims, 4 Drawing Sheets

APPARATUS AND METHOD FOR INJECTING FUEL IN CYLINDER INJECTION TYPE ENGINES

BACKGROUND OF THE INVENTION

The present invention relates to fuel injection controllers and fuel injection control methods that supply fuel to internal combustion engines, and more particularly, to fuel injection controllers and fuel injection control methods that change fuel injection modes in accordance with the operating conditions of engines.

In a typical automotive engine, fuel is injected into an intake passage and mixed homogeneously with air that passes through the intake passage. The homogeneous air fuel mixture is then sent to combustion chambers defined in the engine. In each combustion chamber, the air fuel mixture is ignited by a spark plug. This burns the mixture and produces drive force.

The combustion of the air fuel mixture in such homogeneous state is normally referred to as homogeneous charge combustion. In an engine that performs homogeneous charge combustion, a throttle valve is located in the intake passage to adjust the amount of air fuel mixture drawn into the combustion chambers and thus control the engine torque.

However, in engines that perform homogeneous combustion, the throttling action of the throttle valve decreases the pressure in the intake passage. This increases energy loss due to pumping (pumping loss) when the air fuel mixture is drawn into the combustion chambers from the intake passage and thus decreases the efficiency of the engine.

Stratified charge combustion solves this problem. In stratified charge combustion, fuel is injected directly into each combustion chamber. This delivers a rich, highly combustible air fuel mixture to the vicinity of the spark plug. Ignition of the rich air fuel mixture burns the surrounding lean air fuel mixture. In an engine that performs stratified charge combustion, the engine torque is basically controlled by adjusting the amount of fuel injected toward the vicinity of the spark plug. Accordingly, the throttling by the throttle valve becomes unnecessary. Thus, pumping loss is reduced and the efficiency of the angina is improved. Furthermore, in an engine that performs stratified charge combustion, the overall air fuel mixture is usually lean. This improves fuel efficiency.

Japanese Unexamined Patent Publication No. 7-103050 describes an engine that performs stratified charge combustion and homogeneous combustion in accordance with the state of the engine. In this engine, a first type of fuel injector (direct injector) injects fuel directly into the combustion chamber of each engine cylinder. A second type of fuel injector (indirect injector) injects fuel into the intake passage. Each direct fuel injector is connected to a fuel distribution pipe. Fuel is pressurized and forced through the distribution pipe from a fuel tank by a high pressure pump, which is driven by the engine. The fuel delivered through the distribution pipe is directly injected into each combustion chamber by the associated direct fuel injectors.

The indirect fuel injector is connected to another fuel distribution pipe. Fuel is pressurized and forced through the distribution pipe from the fuel tank by a low pressure pump. The fuel delivered through the distribution pipe is injected into the intake passage.

Stratified charge combustion is performed when the engine speed and the depression degree of the acceleration pedal are both small. Fuel is injected from each fuel injector of the first type when the associated cylinder is in the late stage of the compression stroke. Homogeneous charge combustion is performed when either the engine speed or the depression degree of the acceleration pedal becomes great. Fuel is injected from the indirect fuel injector during the intake stroke of each cylinder. In this manner, the engine shifts combustion modes between stratified charge combustion and homogeneous charge combustion in accordance with the operating conditions of the engine.

When performing stratified charge combustion, fuel must be injected into each commotion chamber when the associated cylinder is in the late stage of the compression stroke. Thus, the fuel injection pressure of each direct fuel injector, or the fuel pressure in the fuel distribution pipe to which the direct fuel injectors are connected, must be maintained at a high pressure. Accordingly, if the fuel pressure in the distribution pipe is not within a predetermined range due to an abnormality in the high pressure pump or other reasons, the required amount of fuel may not be injected from each direct fuel injector.

In the engine described in the above publication, this problem is solved by stopping the injection of fuel from the direct fuel injectors. When an abnormality occurs in the high pressure pump, the pressure in the distribution pipe, to which the direct fuel injectors are connected, falls below an acceptable level. If an unacceptably low injection pressure is detected, it is determined that the required amount of fuel cannot be injected from the direct fuel injectors. In this case, the injection of fuel from the direct fuel injectors is stopped, and the indirect fuel injector is employed. Accordingly, stable operation of the engine is continued by changing the fuel injection mode if an abnormality occurs in the high pressure pump.

When the engine is started, the ignition of the fuel is difficult. Thus, combustion tends to be unstable. Accordingly, if fuel is injected directly into each engine cylinder from the associated direct fuel injector when starting the engine, it is preferable that the injection pressure in the direct fuel injector be high. High injection pressure results in the injection of vaporized fuel and enhances the ignition of the fuel. This shortens the length of time required to start the engine and improves efficiency when starting the engine.

However, the amount of fuel discharged from the high pressure pump is normally low when starting the engine. Therefore, it is difficult to increase the fuel pressure in the distribution pipe to a point at which the fuel can be vaporized in a satisfactory manner. Furthermore, when the engine is started, the temperature of the engine is normally low. Thus, the heat of the engine cannot be used to vaporize the fuel. As a result, the fuel may not be sufficiently vaporized even if the fuel pressure in the fuel distribution pipe is high enough to inject the required amount of fuel from the direct fuel injectors. This may lower the starting efficiency of the engine.

In the engine described in the above publication, the fuel injection mode is changed when the injection of the required amount of fuel is hindered due to a decrease in the fuel injection pressure of the direct fuel injectors. However, as long as the fuel injection pressure in each direct fuel injector is higher than a pressure value that enables the injection of the required amount of fuel, fuel is injected from the direct fuel injectors during the compression stroke, even when the engine is being started. Therefore, when the engine is started, fuel may not be vaporized sufficiently even if the fuel pressure in the direct fuel injectors is high enough to inject the required amount of fuel. This may lower the starting efficiency of the engine. Thus, in the prior art, the problem of inefficiency during engine starting has not sufficiently been dealt with.

SUMMARY OF THE INVENTION

Accordingly, it is an objective of the present invention to provide a fuel injection controller and a fuel injection control method that guarantees efficient starting of internal combustion engines.

To achieve the above objective, in a first aspect of the present invention, an apparatus for controlling fuel injection in an internal combustion engine is provided. Air fuel mixture is delivered to a combustion chamber. The engine is able to perform a plurality of fuel injection modes including at least one homogeneous mode where the fuel is relatively homogeneously mixed with air in the combustion chamber prior to combustion. The apparatus comprises an injection device for injecting fuel to supply fuel into the combustion chamber. An intake passage is connected to the combustion chamber for supplying air to the combustion chamber. A cranking detector determines whether the engine is being cranked. A vapor estimator estimates whether fuel injected from the injection device is able to properly vaporize in the combustion chamber. A controller controls the injection device. The controller selects the homogeneous mode from the plurality of fuel injection modes when the cranking detector determines that the engine is being cranked and the vapor estimator estimates that the injected fuel will not properly vaporize. The controller controls the injection device according to the selected fuel injection mode.

In a second aspect of the present invention, a method for controlling fuel injection in an internal combustion engine that introduces air fuel mixture into a combustion chamber to perform combustion. The engine includes an injection device for injecting fuel to supply fuel into the combustion chamber. The engine is able to perform a plurality of fuel injection modes including a homogeneous mode whereby the fuel is relatively homogeneously mixed with air in the combustion chamber prior to combustion. The method comprises the steps of determining whether the engine is being cranked, determining whether fuel injected from the injection device will adequately vaporize in the combustion chamber, selecting the homogeneous mode from the plurality of fuel injection modes when the engine is being cranked and the injected fuel will not adequately vaporize, and controlling the injection device according to the selected fuel injection mode.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are net forth with particularity in the appended claims. The invention, together with objects and advantages thereof, may best be understood by reference to the following description of the presently preferred embodiments together with the accompanying drawings in which:

FIG. 3(*b*) is a continuation of the flowchart of FIG. 3(*a*) showing the routine for controlling fuel injection.

DETAILED DESCRIPTION OF THE PREFERRED EMBODIMENT

An engine fuel injection controller according to the present invention will now be described with reference to the drawings.

Figure 1:
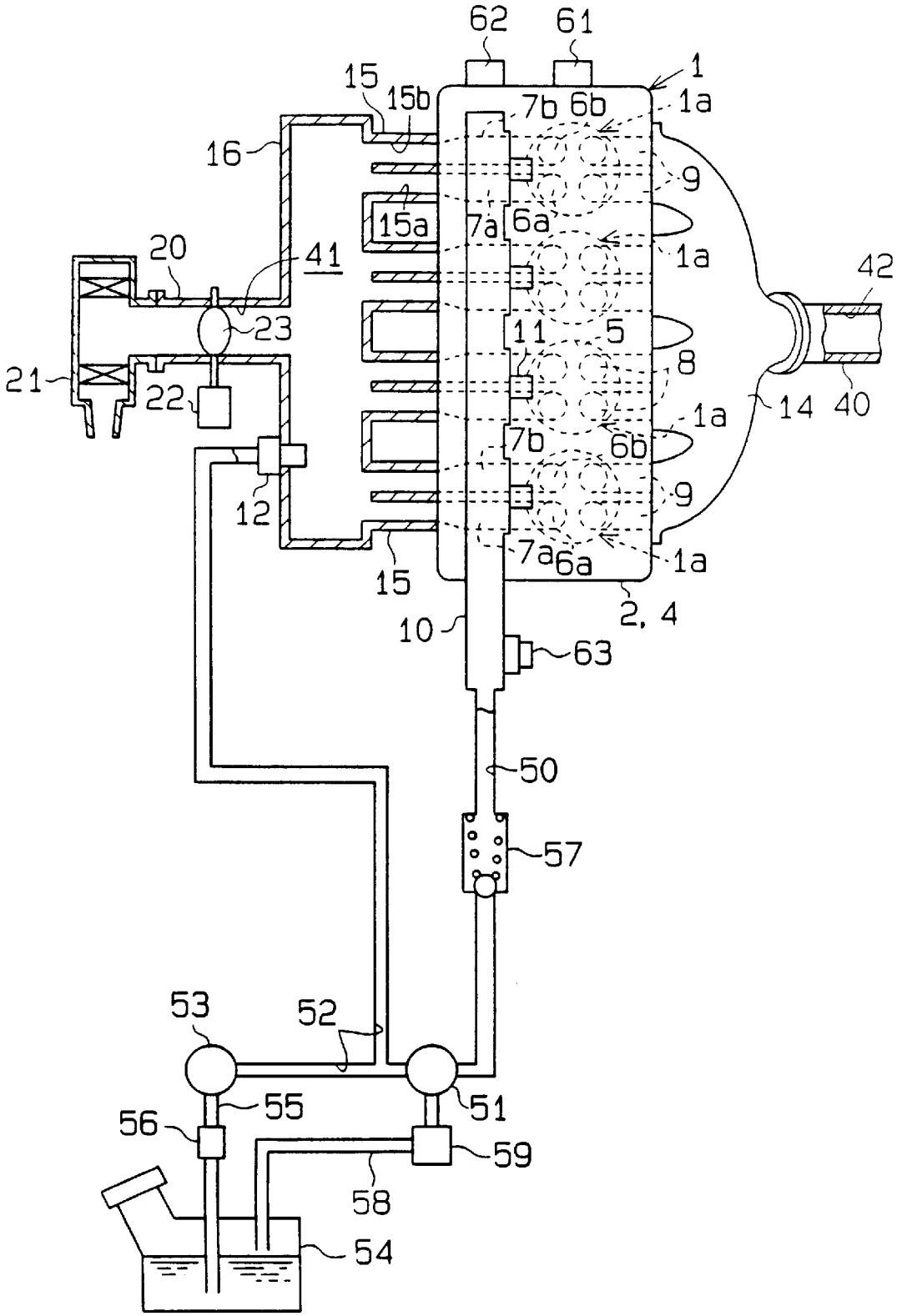
FIG. 1 is a schematic view showing a fuel injection controller according to the present invention.

FIG. 1 is a schematic view showing a fuel injection controller of a gasoline engine installed in automobiles. An engine 1 has four cylinders 1*a*. The engine 1 has a cylinder block 2 that houses the cylinders 1*a*. Each cylinder 1*a* accommodates a piston (not shown). A cylinder head 4 is arranged on top of the cylinder block 2. A combustion chamber 5 is defined in the space formed between the wall of each cylinder 1*a*, the associated piston, and the cylinder head 4.

Each combustion chamber 5 has a first intake port 7*a* and a second intake port 7*b*. The first intake port 7*a* is opened and closed by a first intake valve 6*a*, while the second intake port 7*b* is opened and closed by a second intake valve 6*b*.

A fuel distribution pipe 10 extends through the cylinder head 4 near the first and second intake valves 6*a*, 6*b*. A main injector 11 is provided for each cylinder 1*a* and connected to the distribution pipe 10. The injectors 11 inject fuel directly into the associated cylinder 1*a* when performing both stratified charge combustion and homogeneous charge combustion. Stratified charge combustion is performed by injecting fuel into the combustion chamber 5 from the main fuel injector 11 when the associated piston is in the final stage of its compression stroke. The fuel is concentrated around a spark plug (not shown) and then ignited. Homogeneous charge combustion is performed by injecting fuel into the combustion chamber 5 from the main fuel injector 11 when the associated piston is in the intake stroke. The injected fuel is mixed homogeneously with air, which is drawn into the combustion chamber 5 through the associated intake ports 7*a*, 7*b*, and then burned.

The first intake port 7*a* of each cylinder 1*a* is connected with a first intake passage 15*a* while the second intake port 7*a* is connected to a second intake passage 15*b*. The first and second intake passages 15*a*, 15*b* extend through an intake manifold 15 and connect the associated cylinder 1*a* to a surge tank 16.

The surge tank 16 is connected to a sub-injector 12. Fuel is injected into the surge tank 16 from the sub-injector 12 when performing homogeneous charge combustion. The fuel injected from the sub-injector 12 consists of droplets having extremely fine diameters in comparison with the fuel injected from the main injectors 11.

The surge tank 16 is connected to an air cleaner 21 through an intake duct 20. An electronically controlled throttle valve 23, which is opened and closed by a step motor 22, is arranged in the intake duct 20. An electronic control unit (ECU) 30 sends pulse signals to drive the step motor 22 and control the opening degree of the throttle valve 23 (throttle opening degree). The intake duct 20, the surge tank 16, and the first and second intake passages 15*b* constitute an intake passage 41.

The distribution pipe 10 is connected to a high pressure pump 51 by a high pressure fuel passage 50. A check valve 57 is provided in the fuel passage 50 to prevent a reversed flow of fuel toward the pump 51. The high pressure pump 51 is connected to a low pressure pump 53 by a low pressure fuel passage 52. The low pressure pump 53 is connected to a fuel tank 54 by a fuel supply passage 55. A fuel filter 56 is arranged in the fuel supply passage 55 to filter the fuel.

The low pressure pump 53 draws in fuel from the fuel tank 54 and forces the fuel toward the high pressure pump 51 through the low pressure fuel passage 52. The low pressure fuel passage 52 is also connected to the sub-injector 12. Accordingly, the fuel in the fuel tank 54.is sent to the sub-injector 12 from the low pressure pump 53.

The engine 1 has a crankshaft (not shown). The crankshaft drives the high pressure pump 51. This pressurizes the fuel to a high pressure and forces the pressurized fuel through the high pressure fuel passage 50 and to the distribution pipe 10.

The high pressure pump 51 is also connected to the fuel tank 54 by a fuel spill passage 58. An electromagnetic spill valve 59 is arranged in the spill passage 58. When the spill valve 59 is opened, the fuel received by the high pressure pump 51 is not further pressurized and sent to the distribution pipe 10 but is returned to the fuel tank 54 through the fuel spill passage 58. When the spill passage 58 is closed by the spill valve 59, the fuel received by the high pressure pump 51 is further pressurized and sent to the distribution pipe 10 through the high pressure fuel passage 50 from the high pressure pump 51. The ECU 30 alters the opening and closing timing of the spill valve 59 to adjust the amount and pressure of the fuel that enters the distribution pipe 10.

Each cylinder 1*a* includes a pair of exhaust ports 9, which are connected with an exhaust manifold 14. Each exhaust port 9 is opened and closed by an exhaust valve 8, which is arranged in the cylinder head 4. After combustion, exhaust gas is discharged from each cylinder 1*a* when the associated exhaust valves 8 are opened. This permits the discharge of exhaust gas through the associated exhaust port 9, the exhaust manifold 14, and the exhaust duct 40. The exhaust manifold 14 and the exhaust duct 40 constitute an exhaust passage 42.

Figure 2:
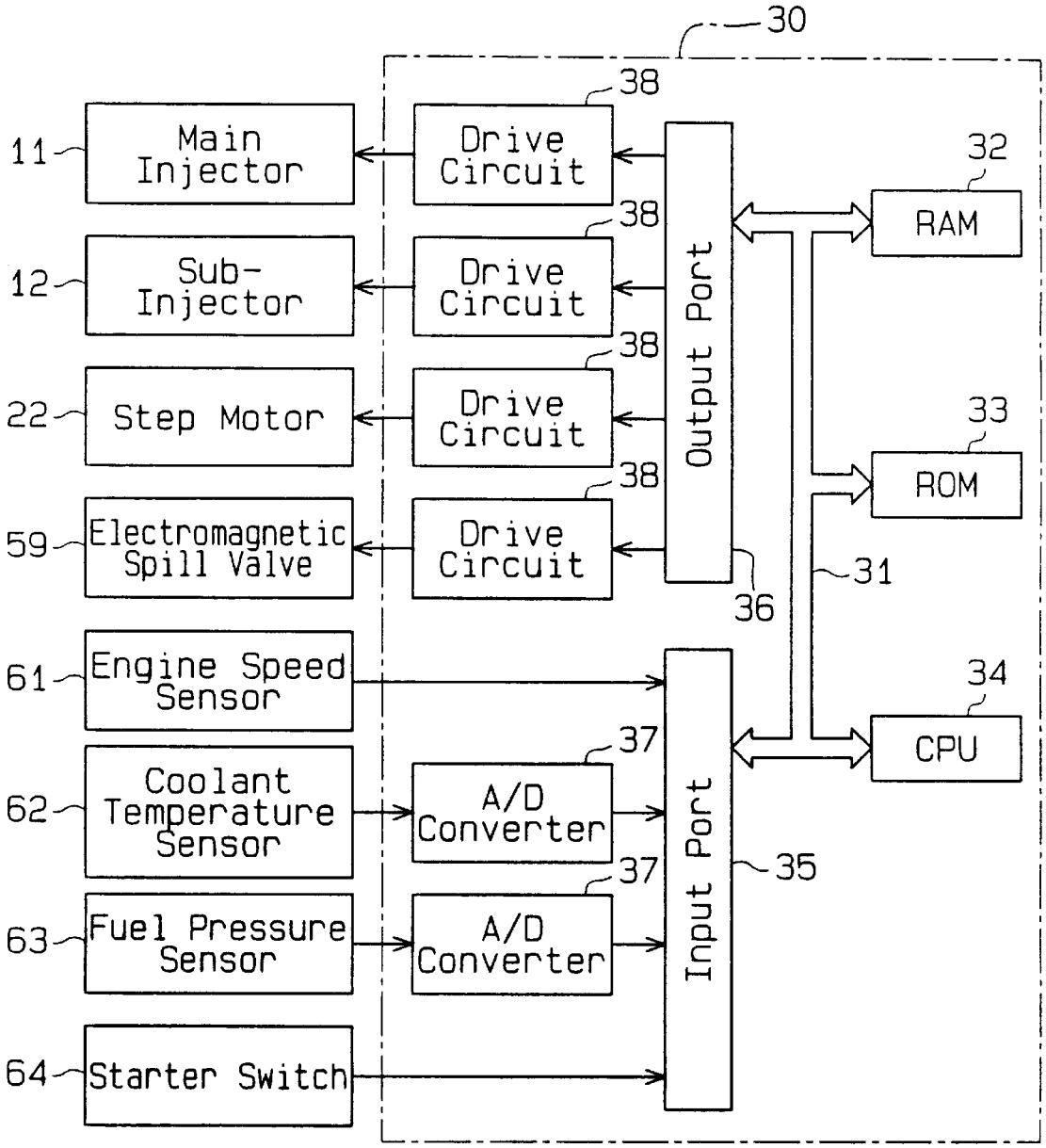
FIG. 2 is an electric block diagram showing the structure of an electronic control unit.

The structure of the ECU 30 is shown in FIG. 2. The ECU 30 has a random access memory (RAM) 32, a read only memory (ROM) 33, a central processing unit (CPU) 34, an input part 35, and an output port 36 that are connected to one another by a bidirectional bus 31.

The engine 1 has an engine speed sensor 61 that detects the engine speed NE of the engine 1. The output pulse is input to the input port 35. The engine speed sensor 61 generates an output pulse, which is input to the input port 35, each time the crankshaft is rotated by a predetermined angle. The CPU 34 computes the engine speed NE in accordance with the output pulses. A coolant temperature sensor 62 is provided in the cylinder block 2 to detect the temperature of the engine coolant (coolant temperature THW). A fuel pressure sensor 63.is located in the distribution pipe 10 to detect the fuel pressure in the pipe 10 (fuel pressure PF). The signal outputs of the sensors 62, 63 are input to the input port 35 by way of A/D converters 37.

The engine 1 includes a starter (not shown) to crank the engine 1. The starter includes a starter switch 64 (FIG. 2) to detect the actuation of the starter The starter is actuated by an ignition switch (not shown). When the starter is actuated by the ignition switch, the starter switch 64 sends a starter signal STA to the input port 35.

The main injectors 11, the sub-injector 12, the step motor 22, and the electromagnetic spill valve 59 are connected to the output port 36 by associated drive circuits 38. In accordance with the signals sent from the sensors 61–64 and other sensors that are not shown, the ECU 30 optimally controls the main injectors 11, the sub-injector 12, the step motor 22, the electromagnetic spill valve 59, and other parts by executing control programs stored in the ROM 33.

Figure 3A:
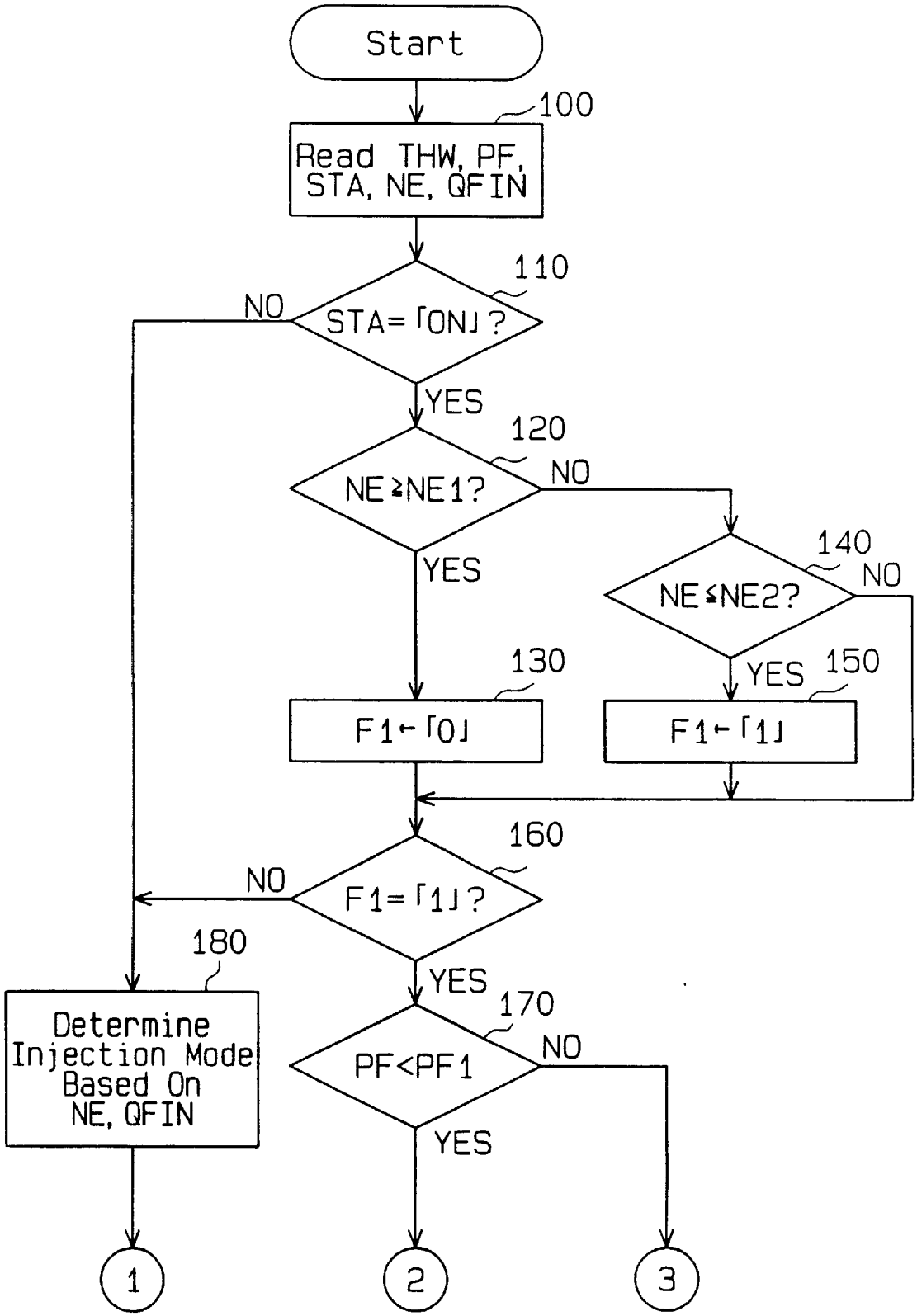
FIG. 3(*a*) is a flowchart showing a routine for controlling fuel injection.
Figure 3B:
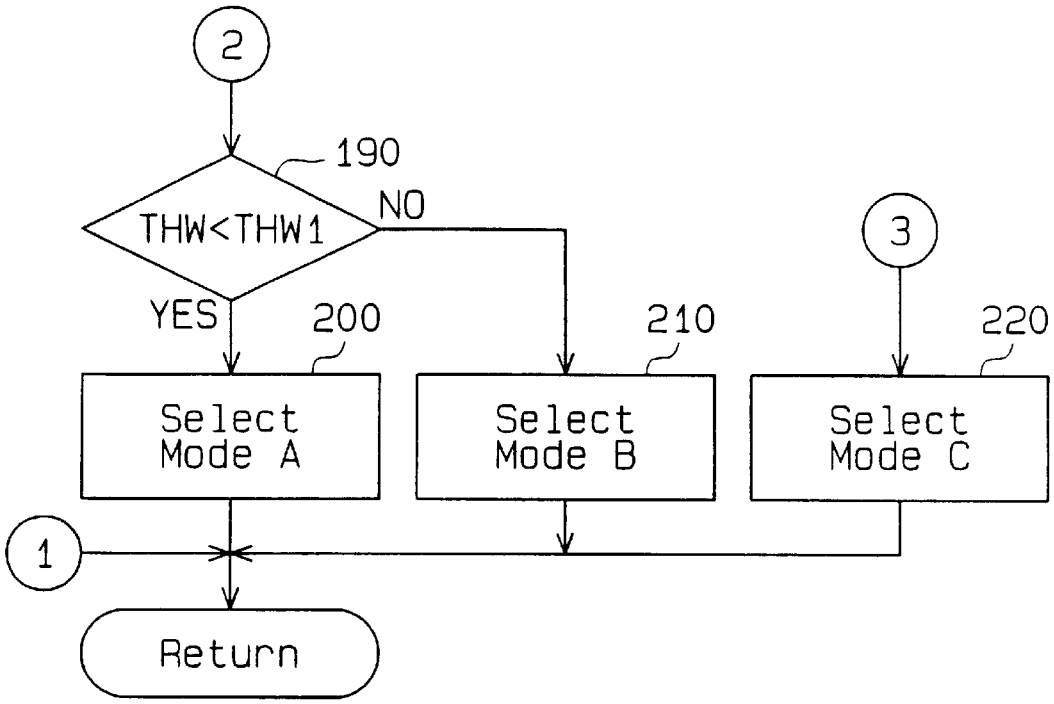

The control carried out by the fuel injection controller incorporated in the engine 1 will now be described in detail. FIGS. 3(*a*) and 3(*b*) show a flowchart of a routine for controlling the fuel injection. This routine is executed cyclically by the ECU 30 for every predetermined time interval.

As shown in FIG. 3(*a*), when entering this routine, at step 100, the ECU 30 reads the coolant temperature THW, the fuel pressure PF, the starter signal STA, and the engine speed NE from the signals sent from the sensors 61–64. The ECU 30 also reads the fuel injection amount QFIN, which is stored in the RAM 32. The fuel injection amount QFIN is computed in another routine in accordance with the depression degree of the acceleration pedal and the engine speed NE and then stored in the RAM 32.

At step 110, the ECU 30 judges whether or not the starter signal STA indicates ON. If it is determined that the starter signal STA does not indicate ON, the engine 1 is not being cranked. In this case, since the engine 1 is not being started, the ECU 30 proceeds to step 180.

Figure 4:
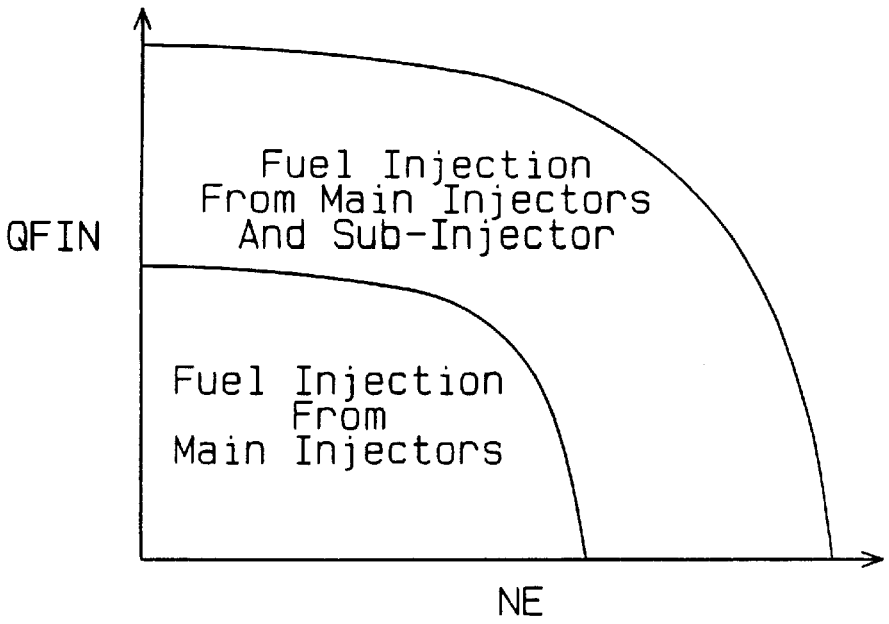
FIG. 4 is graph showing a map that illustrates the relationship between the engine speed and the fuel injection amount with respect to the fuel injection mode.

At stop 180, the ECU 30 determines the fuel injection mode based on the engine speed NE and the fuel injection amount QFIN. The relationship between the engine speed NE and the fuel injection amount QFIN with respect to the fuel injection mode is shown in the graph of FIG. 4. If the values of both the engine speed NE and the fuel injection amount QFIN are small, that is, if the load applied to the engine 1 is low, the injection of fuel from the sub-injector 12 is stopped. In the meantime, the main injectors 11 inject fuel directly into the associated combustion chamber 5 during the compression stroke. As a result, the engine 1 performs stratified charge combustion, which enhances fuel efficiency.

If the value of either the engine speed NE or the fuel injection amount QFIN is large, that is, if the load applied to the engine 1 is large, the main injectors 11 inject fuel directly into the associated combustion chamber 5 during the intake stroke and the sub-injector 12 injects fuel into the surge tank 16. As a result, the engine 1 performs homogeneous charge combustion. This increases engine torque in comparison to when the engine 1 performs stratified charge combustion.

After completing step 180, the ECU 30 temporarily terminates subsequent processing and waits until the next cycle before commencing the routine.

In step 110, if it is determined that the starter signal STA indicates ON, the ECU 30 proceeds to step 120.

At step 120, the ECU 30 judges whether or not the engine speed NE is equal to or higher than a first reference value NE1. The first reference value NE1 is set at 400 rpm and used to determine whether or not the engine 1 is being started. If it is determined that the engine speed NE is equal to or higher than the first reference value NE1, the engine 1 is not being started. In this case, the ECU 30 proceeds to step 130 and sets a starting flag F1 at zero. The starting flag F1 indicates whether the engine 1 is being started in the present state.

If it is determined that the engine speed NE is not equal to or greater than the first reference value NE1 in step 120, the ECU 30 proceeds to step 140.

At step 140, the ECU 30 determines whether the engine speed NE is equal to or lower than a second reference value NE2. The second reference value NE2 is set at 200 rpm and used to determine whether or not the engine 1 is being started.

In stop 140, if it is determined that the engine speed NE is equal to or lower than the second reference value NE2, the engine 1 is being started. In this case, the ECU 30 proceeds to step 150 and sets the starting flag F1 at one it is determined that the engine speed NE is not equal to or lower than the second reference value NE2 in step 140, the ECU 30 proceeds to step 160. The ECU 30 also proceeds to step 160 from steps 130 and 150.

At step 160, the ECU 30 judges whether or not the starting flag F1 indicates one. If it is determined that the starting flag F1 does not indicate one, the engine 30 is not being started. In this case, the engine 30 proceeds to step 180 and then terminates subsequent processing.

In step 160, if it is determined that the starting flag F1 indicates one, the engine 30 is being started. In this case, the ECU 30 proceeds to step 170. At step 170, the ECU 30 judges whether the fuel pressure PF is lower than a reference pressure value PF1. The reference pressure value PF is used to determine whether or not the fuel infected from each main injector 11 into the associated combustion chamber 5 can be sufficiently vaporized. Accordingly, the reference pressure value PF1 is set at a pressure value that is greater than the maximum pressure value in each combustion chamber 5 during the compression stroke. When the fuel pressure PF is equal to or greater than the reference pressure value PF1, each main injector 11 can inject fuel directly into the associated combustion chamber 5, the pressure of which is high. Furthermore, the injected fuel is sufficiently vaporized in the combustion chamber 5.

When the ECU 30 proceeds to step 170, the engine 1 of being started. If it is determined that the fuel pressure PF is not smaller than the reference pressure value PF1 in stop 170, the fuel pressure PF is high enough to sufficiently vaporize the fuel injected from each main injector 11 during the compression stroke. In this case, the ECU 30 proceeds to step 220, which is illustrated in FIG. 3(*b*).

At step 220, the ECU 30 selects the fuel injection mode. Mode C is selected here. When fuel injection mode C is selected, an amount of fuel corresponding to the fuel injection amount QFIN is injected from each main injector 11 in a divided manner. In other words, the fuel from each main injector 11 is injected twice, once during the intake stroke and then during the compression stroke. This results in the engine 1 performing so-called semi-stratified charge combustion.

In step 170, if it is determined that the fuel pressure PF is smaller than the reference pressure value PF1, the engine 1 is being started and the fuel pressure PF is too low to inject fuel from each main injector 11 during the compression stroke. In this case, the ECU 30 proceeds to step 190, which is illustrated in FIG. 3(*b*).

At step 190, the ECU 30 judges whether or not the coolant temperature THW is lower than a reference temperature value THW1. The reference temperature value THW1 is used to determine whether or not the temperature of the cylinder block 2, the cylinder head 4, and other parts have risen to a value that indicates sufficient heat for vaporizing the fuel injected from the associated main injector 11.

In step 190, if it is determined that the coolant temperature THW is not lower than the reference temperature value THW1, there is a possibility that the fuel from each main injector 11 may not be vaporized sufficiently when injected during the compression stroke. However, the injected fuel will be vaporized by the heat in the associated combustion chamber 5. In this case, the ECU 30 proceeds to step 210.

At step 210, the ECU 30 selects fuel injection mode B. When fuel injection mode B is selected, an amount of fuel corresponding to the fuel injection amount QFIN is injected from each main injector 11 during the intake stroke. This results in the engine 1 performing homogeneous charge combustion.

In step 190, if it is determined that the coolant temperature THW is lower than the reference temperature value THW1, there is not only a possibility that the fuel from each main injector 11 may not be vaporized sufficiently when injected during the compression stroke, but the injected fuel will not be vaporized by the heat in the associated combustion chamber 5. In this case, the ECU 30 proceeds to step 200.

At step 200, the ECU 30 selects fuel injection mode A. When fuel injection mode A is selected, an amount of fuel corresponding to the fuel injection amount QFIN is divided and injected from each main injector 11 and the sub-injector 12 during the intake stroke. This results in the engine 1 performing homogeneous charge combustion.

After carrying out either one of steps 200, 210, and 220, the ECU 30 terminates subsequent processing and waits until the next cycle before commencing the routine.

As described above, during starting of the engine 1, when the value of the fuel pressure PF is small, the injection of fuel from each main injector 11 in the compression stroke may be hindered and the fuel injected from each main injector 11 may not be vaporized sufficiently in the associated combustion chamber 5. In such cases, when the engine 1 is hot, fuel is injected into the combustion chamber 5 from the main injector 11 only during the intake stroke (injection mode B). During the intake stroke, the pressure in the combustion chamber 5 is low and the fuel injection pressure of the main injector 11 is relatively high. Thus, the injected fuel will be sufficiently vaporized in view of the heat available.

Furthermore, there is a sufficient length of time between the intake stroke and the combustion/expansion stroke, which follows the compression stroke, for mixing. Therefore, the fuel injected into the combustion chamber 5 is satisfactorily mixed with the air drawn in through the associated intake ports 7*a*, 7*b*. Accordingly, the homogeneously mixed air fuel mixture in the combustion chamber 5 is highly combustible. This shortens the length of time required for starting the engine 1 and guarantees satisfactory starting of the engine 1.

When the coolant temperature THW is low, that is, when the temperature of the engine 1 is low, there is not enough heat to vaporize the fuel injected into each combustion chamber 5. In this case, fuel injection mode A is selected. In fuel injection mode A, fuel is injected from each main injector 11 and the sub-injector 12 during the intake stroke. The fuel injected from the sub-injector 12 has sufficient time to mix with air before reaching the designated combustion chamber 5 by way of the intake manifold 15. Thus, the fuel is homogeneously mixed with air. Accordingly, the homogeneously mixed air fuel mixture in the compression chamber is highly combustible. This guarantees satisfactory starting of the engine 1 even when the temperature of the engine 1 is low.

In the preferred and illustrated embodiment, the fuel injected from the sub-injector 12 consists of droplets having extremely fine diameters in comparison with the fuel injected from the main injectors 11. This improves the homogeneous mixing of air and fuel in the combustion chambers 5 and further improves starting of the engine 1.

In the preferred and illustrated embodiment, when the engine 1 is started, the optimal injection mode that results in satisfactory starting and enhanced fuel efficiency is selected in accordance with the fuel pressure PF (fuel injection pressure) and the coolant temperature (engine temperature). After the engine 1 is started, the optimal mode for satisfactory starting and enhanced fuel efficiency is selected in accordance with the load applied to the engine 1.

It should be apparent to those skilled in the art that the present invention may be embodied in many other specific forms without departing from the spirit or scope of the invention. Particularly, it should be understood that the invention may be embodied in the following forms.

In the preferred and illustrated embodiment, the reference pressure value PF1 is set at a constant pressure value that is greater than the maximum pressure value in the combustion chamber 5 during the compression stroke. The maximum pressure value differs slightly in accordance with the engine speed NE and the intake air amount. Hence, the reference pressure value PF1 may be set in accordance with the engine speed NE or the fuel injection amount QFIN. This improves the accuracy of the determination of whether or not the fuel pressure PF is sufficient for injecting properly vaporized fuel from the injector 11 during the compression stroke.

In the preferred and illustrated embodiment, fuel is injected from the sub-injector 12 in addition to the main injectors 11 if the fuel pressure PF is lower than the reference pressure value PF1 and the coolant temperature THW is lower than the reference temperature value THW1 (mode A). However, fuel may be injected from the sub-injector 12 in addition to the main injectors 11 during fuel injection mode A even if only one of these conditions are satisfied (either the fuel pressure PF is lower than the reference pressure value PF1 or the coolant temperature THW is lower than the reference temperature value THW1).

In the preferred and illustrated embodiment, the starting of the engine 1 is recognized from the starter signal STA and the engine speed NE. However, the starting of the engine 1 may be recognized from the starter signal STA alone or the engine speed NE alone.

In step 170, if it is determined that the fuel pressure PF is not lower than the reference pressure value PF1, the ECU 30 proceeds to step 220. However, instead of proceeding to step 220, the ECU 30 may proceed to step 180. This procedure also ensures that the fuel sent into each combustion chamber 5 is properly vaporized and guarantees satisfactory starting of the engine 1.

Therefore, the present examples and embodiments are to be considered as illustrative and not restrictive and the invention is not to be limited to the details given herein, but may be modified within the scope and equivalence of the appended claims.

What is claimed is:

1. An apparatus for controlling fuel injection in an internal combustion engine, wherein air fuel mixture is delivered to a combustion chamber, wherein the engine is able to perform a plurality of fuel injection modes including at least one homogeneous mode where the fuel is relatively homogeneously mixed with air in the combustion chamber prior to combustion, the apparatus comprising:

an injection device for injecting fuel to supply fuel into the combustion chamber;

an intake passage connected to the combustion chamber for supplying air to the combustion chamber;

a cranking detector for determining whether the engine is being cranked;

a vapor estimator for estimating whether fuel injected from the injection device is able to properly vaporize in the combustion chamber; and a controller for controlling the injection device, wherein the controller selects the homogeneous mode from the plurality of fuel injection modes when the cranking detector determines that the engine is being cranked and the vapor estimator estimates that the injected fuel will not properly vaporize, and wherein the controller controls the injection device according to the selected fuel injection mode.

2. The apparatus according to claim 1, wherein the vapor estimator includes a pressure detector for detecting the fuel pressure of the injection device, wherein the vapor estimator estimates that the injected fuel will not properly vaporize when the detected fuel pressure is under a predetermined value.

3. The apparatus according to claim 2, wherein the injection device includes a direct fuel injection valve for injecting fuel directly into the combustion chamber, wherein the pressure detector detects the pressure of fuel within the injection valve, and wherein the predetermined value is greater than maximum possible value of the pressure in the combustion chamber during a compression stroke of the engine.

4. The apparatus according to claim 1, wherein the vapor estimator includes a temperature detector for detecting the temperature of a part of the engine, wherein the vapor estimator estimates that the injected fuel will not properly vaporize when the detected temperature is under a predetermined value.

5. The apparatus according to claim 4, wherein the temperature detector detects the temperature of a liquid coolant flowing in the engine.

6. The apparatus according to claim 1, wherein the injection device includes a first injection valve for directly injecting fuel into the combustion chamber and a second injection valve for injecting fuel into the intake passage, wherein the second injection valve injects fuel during the homogeneous mode.

7. The apparatus according to claim 6, wherein the controller causes the first and second injection values to inject fuel during an intake stroke of the engine when the homogeneous mode is selected.

8. The apparatus according to claim 1, wherein the injection device injects fuel during an intake stroke of the engine during the homogeneous mode.

9. The apparatus according to claim 8, wherein the injection device includes a direct fuel injection valve for injecting fuel directly into the combustion chamber, wherein the controller permits the direct injection valve to inject fuel only during the intake stroke of the engine when the homogeneous mode is selected.

10. The apparatus according to claim 1, wherein the cranking detector includes at least one of a starter actuation detector for detecting whether an engine starter is being actuated and a speed detector for detecting the engine speed.

11. An apparatus for controlling fuel injection in an internal combustion engine, wherein air fuel mixture is delivered to a combustion chamber, wherein the engine is able to perform a plurality or fuel injection modes including at least one homogeneous mode where the fuel is relatively homogeneously mixed with air in the combustion chamber prior to combustion, the apparatus comprising:

an injection device for injecting fuel to supply fuel into the combustion chamber, wherein the injection device includes at least a first injection valve for directly injecting fuel into the combustion chamber;

an intake passage connected to the combustion chamber for supplying air to the combustion chamber;

a cranking detector for determining whether the engine is being cranked;

a pressure detector for detecting the pressure of fuel within the first injection valve;

a temperature detector for detecting the temperature of a part of the engine;

a vapor estimator for estimating that fuel injected from the first injection valve will not properly vaporize in the combustion chamber when the detected fuel pressure is under a predetermined value and when the detected temperature is under a predetermined value; and a controller for controlling the injection device, wherein the controller selects the homogeneous mode from the plurality of fuel injection modes when the cranking detector determines that the engine is being cranked and the vapor estimator estimates that the injected fuel will not properly vaporize, and wherein the controller controls the injection device according to the selected fuel injection mode.

12. The apparatus according to claim 11, wherein the injection device further includes a second injection valve for injecting fuel into the intake passage, wherein the second injection valve injects the fuel during the homogeneous mode.

13. The apparatus according to claim 12, wherein the controller causes the first and second injection valves to inject fuel during an intake stroke of the engine when the homogeneous mode is selected.

14. An apparatus for controlling fuel injection in an internal combustion engine, wherein air fuel mixture is delivered to a combustion chamber, wherein the engine is able to perform a plurality of fuel injection modes including at least a first homogeneous mode and a second homogeneous mode, wherein the fuel is relatively homogeneously mixed with air in the combustion chamber prior to combustion in both the first and second homogeneous modes, the apparatus comprising:

an intake passage connected to the combustion chamber for supplying air to the combustion chamber;

a first injection valve for directly injecting fuel into the combustion chamber, wherein the first injection valve injects the fuel during an intake stroke of the engine during the second homogeneous mode;

a second injection valve for injecting fuel into the intake passage, wherein the first and second injection valves inject fuel during the intake stroke of the engine during the first homogeneous mode;

a cranking detector for determining whether the engine is being cranked;

a pressure detector for detecting the pressure of fuel within the first injection valve;

a temperature detector for detecting the temperature of a part of the engine; and a controller for controlling the first and second injection valves, wherein the controller selects the second homogeneous mode from the plurality of fuel injection modes when the detected fuel pressure is under a first predetermined value and the detected temperature is above a second predetermined value and the cranking detector determines that the engine in being cranked, and wherein the controller selects the first homogeneous mode from the plurality of fuel injection modes when the detected fuel pressure is under the first predetermined value and the detected temperature is under the second predetermined value and the cranking detector determines that the engine is being cranked.

15. A method for controlling fuel injection in an internal combustion engine that introduces air fuel mixture into a combustion chamber to perform combustion, wherein the engine includes an injection device for injecting fuel to supply fuel into the combustion chamber and is able to perform a plurality of fuel injection modes including a homogeneous mode whereby the fuel is relatively homogeneously mixed with air in the combustion chamber prior to combustion, the method comprising the steps of:

determining whether the engine is being cranked;

determining whether furl injected from the injection device will adequately vaporize in the combustion chamber;

selecting the homogeneous mode from the plurality of fuel injection modes when the engine is being cranked and the injected fuel will not adequately vaporize; and controlling the injection device according to the selected fuel injection mode.

16. The method according to claim 15 further comprising:

detecting the pressure of fuel within the injection device; and determining that the injected fuel will not adequately vaporize when the detected fuel pressure is under a predetermined value.

17. The method according to claim 15 further comprising:

detecting the temperature of a part of the engine; and determining that the injected fuel will not adequately vaporize when the detected temperature is under a predetermined value.

* * * * *